US006159912A

United States Patent [19]

McDonald

[11] Patent Number: 6,159,912

[45] Date of Patent: Dec. 12, 2000

[54] LOW VISCOSITY, CHLORIDE-FREE, LOW OVERBASED ALKYL-ARYL-SULFONATE, ITS APPLICATION AS AN ADDITIVE FOR LUBRICATING OIL, AND METHODS OF PREPARATION

[75] Inventor: John McDonald, Emeryville, Calif.

[73] Assignee: Chevron Chemical Company LLC, San Ramon, Calif.

[21] Appl. No.: 09/186,472

[22] Filed: Nov. 5, 1998

[51] Int. Cl.[7] ..... C10M 159/24; C10M 159/22; C10M 159/20

[52] U.S. Cl. ..... 508/395; 508/391; 508/398; 508/399; 508/400; 508/586; 508/417

[58] Field of Search ..... 508/391, 398, 508/399, 400, 586, 395, 417

[56] References Cited

U.S. PATENT DOCUMENTS

| | | | |
|---|---|---|---|
| 4,764,295 | 8/1988 | LeCoent | 252/33 |
| 5,792,735 | 8/1998 | Cook et al. | 508/452 |
| 5,804,094 | 9/1998 | Alcock et al. | 252/18 |
| 5,922,655 | 7/1999 | Moulin et al. | 508/390 |

FOREIGN PATENT DOCUMENTS

| | | | |
|---|---|---|---|
| 1 575 957 | 3/1977 | United Kingdom | C07C 143/34 |

*Primary Examiner*—Jerry D. Johnson
*Attorney, Agent, or Firm*—W. K. Turner; R. J. Sheridan

[57] ABSTRACT

A low overbased alkyl phenyl sulfonate prepared by the neutralization of sulfonic acid with a sulfurized high TBN calcium alkylphenate in the absence of chloride and in the absence of additional carboxylic acid.

12 Claims, No Drawings

LOW VISCOSITY, CHLORIDE-FREE, LOW OVERBASED ALKYL-ARYL-SULFONATE, ITS APPLICATION AS AN ADDITIVE FOR LUBRICATING OIL, AND METHODS OF PREPARATION

The present invention relates to a low overbased (LOB) alkyl aryl sulfonate, its application as detergent/dispersant additives for lubricating oils, and methods for preparing same.

BACKGROUND OF THE INVENTION

The present invention relates to low viscosity, low base number sulfonates and to processes for the production of these sulfonates. The invention also relates to oil based compositions containing these low base number sulfonates.

Basic or neutral sulfonates may be used as additives in lubricating oils for petrol engines and diesel engines for example for vehicles or marine engines. Neutral and low base number sulfonates function primarily as detergents to keep engine surfaces clean. High base number sulfonates are primarily used to neutralize acids produced in the oil during use. These sulfonates may help to inhibit corrosion.

Neutral and low base number sulfonates for use as oil additives are usually prepared by the neutralization of a sulfonic acid with a basic salt such as a basic calcium salt e.g. calcium oxide or hydroxide in a suitable diluent oil. The sulfonate product may be a mixture of a number of species. In addition dispersed calcium hydroxide may be present.

The product of this process may display some basicity, for example if the basic salt is added in stoichiometric excess to that required for complete neutralization of the sulfonic acid, or some other basic component is present. The product in this case is said to be overbased.

The neutral metal salts of typical sulfonic acids are extremely viscous materials and would have a TBN, as measured by ASTM D-2896, of zero. Methods have been sought which permit lower viscosity products to be prepared. This has been achieved by the incorporation of chloride, formate and hydroxide ions into the product. The products of these techniques are not truly neutral but are slightly overbased in that they contain more base than that required to react stoichiometrically with the sulfonic acid.

U.S. Pat. No. 4,764,295 discloses a process for the production of low base number sulfonates from sulfonic acids which have alkyl radicals of $C_{15}$ to $C_{40}$; the process uses chloride containing salts and carboxylic acids such as formic acid. The products have relatively low viscosity but contain chloride.

High base number sulfonates are generally prepared by a process of neutralization with excess base (overbasing) followed by carbonation. Typically the sulfonic acid is neutralized with excess basic metal oxide or hydroxide in a suitable diluent. Some of the excess basic metal oxide or hydroxide is converted to metal carbonate via carbonation. Typically the reaction is carried out in the presence of hydrocarbon and/or polar solvents such as toluene/methanol and diluent oil; some or all of these solvents may be subsequently removed. The resulting product is a colloidal dispersion, in a diluent oil, of sub-micron particles of $CaCO_3$ and $Ca(OH)_2$ which are sterically stabilised by the calcium sulfonate species produced by the reaction.

Sulfonates have been prepared from synthetic sulfonic acids which have in turn been prepared for example by the sulfonation of $C_{12}$ to $C_{60+}$ alkyl substituted benzene, or xylene or toluene compounds and mixtures thereof. It has been found that some synthetic sulfonic acids are difficult to neutralize with for example calcium hydroxide or lime to produce sulfonates which have acceptable properties; the attempted neutralization results in the production of gelatinous products which for example are solid at room temperature. This is a particular problem when trying to prepare Neutral or Low Base Number Sulfonates from such sulfonic acids. Methods have been proposed to overcome this problem associated with synthetic sulfonic acids. One such method for sulfonic acids of molecular weight 480–540 is described in GB 1 575 957 wherein a large stoichiometric excess, over that required for neutralization of the sulfonic acid, of calcium hydroxide is added to a portion of the sulfonic acid in a diluent to produce a reaction mixture; the remainder of the sulfonic acid is subsequently added to the mixture, this addition being less than that which would be required to fully react with the remaining calcium hydroxide in the mixture. In addition a solution containing a source of chloride ion is added to the mixture after the calcium hydroxide or lime addition. The chloride ion is believed to act as a fluidizer for the product formation and is beneficial in enabling the production of fluid, filterable products from certain sulfonic acids such as synthetic sulfonic acids. The addition of chloride promoter prevents the formation of gelatinous products; however, the final product, contains chloride.

The presence of chloride in calcium sulfonates and other metal sulfonates is a problem from a waste disposal and environmental point of view. When compositions containing such sulfonates are destroyed, e.g. by incineration, harmful chlorinated and polychlorinated biphenyls may be produced. Waste disposal of compositions based on chloride containing sulfonates is therefore a problem; it would be advantageous to be able to produce chloride-free low base number sulfonates especially those derived from high molecular weight sulfonic acids without a loss of the beneficial properties associated with the use of chloride in their manufacture.

Thus, a need exists for low base number sulfonates and methods for making such sulfonates which do not have the foregoing problems of high levels of chloride ions, high viscosity, and sediment.

U.S. Pat. No. 5,804,094, entitled "Low base number sulfonates" discloses low base number sulfonates derived from high molecular weight sulfonic acids that have low viscosity and are chloride free. In their preparation, neutralization of high molecular weight sulfonic acids or partially neutralized soaps of high molecular weight sulfonic acids is completed by the use of a high base number sulfonate in conjunction with a carboxylic acid.

SUMMARY OF THE INVENTION

The present invention provides a process for producing a low viscosity, low overbased alkyl aryl sulfonate (such as an alkyl phenyl sulfonate). That process comprises the neutralization of sulfonic acid with a high TBN metal salt of an alkyl hydroxyl aromatic (such as a carbonated alkaline earth alkylphenate). Preferably the sulfonic acid is added to the alkyl hydroxyl aromatic, but the alkyl hydroxyl aromatic can be added to the sulfonic acid. Part or all of the neutralization of the sulfonic acid can be provided by lime, but phenate must be added to reduce the viscosity of the finished product and provide a source of overbasing. The presence of the phenate in the soap reduces the viscosity of the soap. In addition to its essential role in reducing viscosity, the phenate can also serve as a source of overbasing.

Preferably, the alkaline earth metal is calcium, and the alkyl group has from 10 to 40 carbon atoms.

Preferably, the neutralization step should be carried out in the absence of chloride and in the absence of additional carboxylic acid.

The low overbased alkyl phenyl sulfonate produced by this process can be used in a lubricating oil formulation comprising:

(a) a major amount of a base oil of lubricating viscosity;

(b) from 0.5 to 40% of the low overbased alkyl phenyl sulfonate of the present invention;

(c) from 0 to 20% of at least one ashless dispersant;

(d) from 0 to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

The low overbased alkyl phenyl sulfonate produced by this process also can be used in a concentrate comprising about from 10 weight % to 90 weight % of a compatible organic liquid diluent and about from 0.5 weight % to 90 weight % of the low overbased alkyl phenyl sulfonate of the present invention.

A lubricating oil composition can be produced by blending the following components together:

(a) a major amount of a base oil of lubricating viscosity;

(b) from 0.5 to 40% of the low overbased alkyl phenyl sulfonate of the present invention;

(c) from 0 to 20% of at least one ashless dispersant;

(d) from 0 to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

DETAILED DESCRIPTION OF THE INVENTION

In its broadest aspect, the present invention involves a low overbased alkyl phenyl sulfonate prepared by a new route (the neutralization of a high TBN metal salt of an alkyl hydroxyl aromatic with sulfonic acid in the absence of chloride and in the absence of additional carboxylic acid), its application as detergent/dispersant additives and additive concentrates for lubricating oils, and methods for preparing said sulfonates.

The product had a viscosity of 50 cSt. About one gallon of high TBN calcium alkylphenate produces about four gallons of LOB sulfonate. Since the neutralization process is fast, there is an overall saving of time in manufacturing resulting in cost savings. Also the lack of chloride is attractive to customers.

Prior to discussing the invention in further detail, the following terms will be defined:

DEFINITIONS

As used herein the following terms have the following meanings unless expressly stated to the contrary:

The term "alkaline earth metal" means the group consisting of calcium, barium, magnesium, and strontium.

The term "Base Number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

The term "overbased detergent" refers to a composition comprising a small amount of diluent (e.g., lubricating oil) and a detergent complex wherein additional alkalinity is provided by a stoichiometric excess of a metal base, based on the amount required to react with the acidic moiety of the detergent.

The term "neutral detergent" refers to a detergent having a BN of up to 30.

The term "normal detergent" refers to a detergent that contains a stochiometric amount of metal base required to neutralize the acidic substituent. Such detergents can actually be basic and typically exhibit a BN of up to 150, and are useful to neutralize engine acids.

The term "moderately overbased detergent" refers to an overbased detergent having a BN of about 150 to 225. Some moderately overbased detergents require carbonation to achieve this level of BN.

The term "high BN, overbased detergent" refers to an overbased detergent having a BN of from 225 to 350, or more. Generally a carbon dioxide treatment is required to obtain high BN overbased detergent compositions. It is believed that this forms a colloidal dispersion of metal base.

Unless otherwise specified, all percentages are in weight percent.

PROCESS FOR PRODUCING THE LOW OVERBASED ALKYL ARYL SULFONATE

A low viscosity, chloride-free, low overbased alkyl-aryl-sulfonate is produced by the neutralization of sulfonic acid with a high TBN metal salt of an alkyl hydroxyl aromatic in the absence of chloride.

THE SULFONIC ACID

The sulfonic acid is prepared by sulfonation of the desired alkylate(s). If two or more alkylates are used, the sulfonation is effected either on the two alkylates separately or either on the mixture of the two alkylates.

The reaction is effected using sulfur trioxide $SO_3$, produced by the passage of a mixture of oxygen and sulfur dioxide $SO_2$ through a catalytic furnace containing vanadium oxide $V_2O_5$.

The gas thus produced is introduced at the top of a sulfonation reactor two meter long and one centimeter diameter in a concurrent alkylate stream. The resulting sulfonic acid is recovered at the bottom of the reactor. The sulfonation conditions are as follows:

$SO_3$/alkylate mole ratio about 1 (from 0.8 to 1.2)

Sulfonation temperature between 50° C. and 60° C.

And with nitrogen as vector gas to dilute the $SO_3$ to 4% by volume

Level of conversion is about 88% and the mineral activity expressed as sulfuric acid is the range 06%–1%. By using a process described in our international patent application PCT/FR 94/01147 filed on Sep. 30, 1994 published on Apr. 3, 1995 under WO 95/09840, the mineral activity is decreased down to 0.30% by a thermal treatment and a dilution by 10% of 100 N.

The analysis given in the table below relative to the embodiments of the present invention correspond to the product obtained after thermal treatment.

THE HIGH TBN METAL SALT OF AN ALKYL HYDROXYL AROMATIC

A wide variety of high TBN metal salts of alkyl hydroxyl aromatics can be used. For instance, the metal can be alkali or alkaline earth, there can be one or more hydroxyl units per molecule, and the aromatic can be benzene, toluene, xylene, etc. Preferably, the metal is alkaline earth metal, most preferably calcium. Preferably, the metal salt of alkyl hydroxyl aromatic is a sulfurized calcium alkylphenate.

One preferred embodiment uses a carbonated sulfurized calcium phenate with 250 TBN. The alkylphenol it is made from is propylene tetramer on phenol.

Another phenate is not carbonated and has a TBN of 114.

THE NEUTRALIZATION PROCESS

Neutralization of the sulfonic acid can be accomplished either with lime or by the phenate or by both. If the sulfonic acid is neutralized first with the lime there results a very viscous product, often referred to as soap. This calcium sulfonate has no excess basic material and probably exists in the form of lamellar micelles. The addition of phenate greatly reduces the viscosity of the soap, probably by disruption of the shape of the lamellar micelles. It may encourage the formation of round micelles. Such round micelles are believed to be encouraged by the presence of chloride in conventional processes for making LOB sulfonate. The neutralization of the acid is done at 100–140° C., but higher or lower temperatures can be used.

If the phenate is used to neutralize the sulfonic acid it is accompanied by the evolution of carbon dioxide if the phenate is carbonated. The more phenate that is used, the lower will become the viscosity of the sulfonate until a point is reached that the product is essentially all phenate. The phenate itself typically has a viscosity of 200–300 cSt, lower than the viscosity of the soap but higher than the viscosity of the resulting LOB sulfonate. The amount of lime and phenate used depends on the required TBN and viscosity. Blending a high TBN phenate with the soap will result in a high TBN for the sulfonate. The TBN can be reduced by using the phenate to neutralize part or all of the sulfonic acid. The addition of the phenate to the neutral soap is believed to be a physical phenomenon. There is no evidence of any chemical reaction.

OTHER ADDITIVE COMPONENTS

The following additive components are examples of components that can be favorably employed in combination with the LOB alkyl aryl sulfonates in the compositions of the present invention:

(1) Ashless dispersants: alkenyl succinimides, alkenyl succinimides modified with other organic compounds, and alkenyl succinimides modified with boric acid, alkenyl succinic ester.

(2) Oxidation inhibitors:

1) Phenol type phenolic) oxidation inhibitors: 4,4'-methylenebis (2,6-di-tert-butylphenol), 4,4'-bis(2,6-di-tert-butylphenol), 4,4'-bis(2-methyl-6-tert-butylphenol), 2,2'-(methylenebis(4-methyl-6-tert-butyl-phenol), 4,4'-butylidenebis(3-methyl-6-tert-butylphenol), 4,4'-isopropylidenebis(2,6-di-tert-butylphenol), 2,2'-methylenebis(4-methyl-6-nonylphenol), 2,2'-isobutylidene-bis(4,6-dimethylphenol), 2,2'-methylenebis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-α-dimethylamino-p-cresol, 2,6-di-tert-4-(N.N' dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-butylbenzyl)-sulfide, and bis (3,5-di-tert-butyl-4-hydroxybenzyl).

2) Diphenylamine type oxidation inhibitor: alkylated diphenylamine, phenyl-α-naphthylamine, and alkylated α-naphthylamine.

3) Other types: metal dithiocarbamate (e.g., zinc dithiocarbamate), and methylenebis (dibutyldithiocarbamate).

(3) Rust inhibitors (Anti-rust agents):

1) Nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, and polyethylene glycol monooleate.

2) Other compounds: stearic acid and other fatty acids, dicarboxilic acids, metal soaps, fatty acid amine salts, metal salts of heavy sulfonic acid, partial carboxylic acid ester of polyhydric alcohol, and phosphoric ester.

(4) Demulsifiers: addition product of alkylphenol and ethyleneoxide, poloxyethylene alkyl ether, and polyoxyethylene sorbitane ester.

(5) Extreme pressure agents (EP agents): zinc dialkyldithiophosphate (Zn-DTP, primary alkyl type & secondary alkyl type), sulfurized oils, diphenyl sulfide, methyl trichlorostearate, chlorinated naphthalene, benzyl iodide, fluoroalkylpolysiloxane, and lead naphthenate.

(6) Friction modifiers: fatty alcohol, fatty acid, amine, borated ester, and other esters (7) Multifunctional additives: sulfurized oxymolybdenum dithiocarbamate, sulfurized oxymolybdenum organo phosphoro dithioate, oxymolybdenum monoglyceride, oxymolybdenum diethylate amide, amine-molybdenum complex compound, and sulfur-containing molybdenym complex compound (8) Viscosity index improvers: polymethacrylate type polymers, ethylene-propylene copolymers, styrene-isoprene copolymers, hydrated styrene-isoprene copolymers, polyisobutylene, and dispersant type viscosity index improvers.

(9) Pour point depressants: polymethyl methacrylate.

(10) Foam Inhibitors: alkyl methacrylate polymers and dimethyl silicone polymers.

OIL OF LUBRICATING VISCOSITY

The oil of lubricating viscosity used in such compositions may be mineral oil or synthetic oils of viscosity suitable for use in the crankcase of an internal combustion engine, such as gasoline engines and diesel engines, including passenger car, heavy duty on-road and off-road, railroad, natural gas and marine, such as trunk piston and slow speed crosshead. Crankcase lubricating oils ordinarily have a viscosity of about 1300 cSt at 0° F. to 24 cSt at 210° F. (99° C.). The lubricating oils may be derived from synthetic or natural sources. Mineral oil for use as the base oil in this invention includes paraffinic, naphthenic and other oils that are ordinarily used in lubricating oil compositions. Synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity, such as didodecyl benzene, can be used. Useful synthetic esters include the esters of both monocarboxylic acids and polycarboxylic acids, as well as monohydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used.

Blends of mineral oils with synthetic oils are also useful. For example, blends of 10% to 25% hydrogenated 1-trimer with 75% to 90% 150 SUS (100° F.) mineral oil gives an excellent lubricating oil base.

LUBRICATING OIL COMPOSITIONS

The additives produced by the process of this invention are useful for imparting detergency and dispersancy properties to the lubricating oil. When employed in this manner, the amount of the LOB alkyl aryl sulfonates ranges from about 0.5% to 40% of the total lubricant composition, although preferably from about 1% to 25% of the total lubricant composition. Such lubricating oil compositions are useful in the crankcase of an internal combustion engine, such as gasoline engines and diesel engines, including passenger car, heavy duty on-road and off-road, railroad, natural gas and marine, such as trunk piston and slow speed crosshead. They are also useful in hydraulic applications.

Such lubricating oil compositions employ a finished lubricating oil, which may be single or multigrade. Multigrade lubricating oils are prepared by adding viscosity index (VI) improvers. Typical VI improvers are polyalkyl methacrylates, ethylene-propylene copolymers, styrene-dine copolymers, and the like. So-called dispersant VI improvers, which exhibit dispersant properties as well as VI modifying properties, can also be used in such formulations.

In one embodiment, a lubricating oil composition would contain (a) a major amount of an oil of lubricating viscosity;

(b) from 0.5% to 40% of the LOB alkyl aryl sulfonates of the present invention;

(c) from 0% to 20% of at least one ashless dispersant;

(d) from 0% to 5% of at least one zinc dithiophosphate;

(e) from 0% to 10% of at least one oxidation inhibitor;

(f) from 0% to 1% of at least one foam inhibitor; and (g) from 0% to 20% of at least one viscosity index improver.

PROCESS FOR PRODUCING THE LUBRICATING OIL COMPOSITION

In one embodiment, a lubricating oil composition is produced by blending a mixture of:

(a) a major amount of an oil of lubricating viscosity;

(b) from 0.5% to 40% of the LOB alkyl aryl sulfonates of the present invention;

(c) from 0% to 20% of at least one ashless dispersant;

(d) from 0% to 5% of at least one zinc dithiophosphate;

(e) from 0% to 10% of at least one oxidation inhibitor;

(f) from 0% to 1% of at least one foam inhibitor; and (g) from 0% to 20% of at least one viscosity index improver.

The lubricating oil composition produced by that method might have a slightly different composition than the initial mixture, because the components may interact. The components can be blended in any order and can be blended as combinations of components.

ADDITIVE CONCENTRATES

Additive concentrates are also included within the scope of this invention. The concentrates of this invention comprise the LOB alkyl aryl sulfonates of the present invention, with at least one of the additives disclosed above. Typically, the concentrates contain sufficient organic diluent to make them easy to handle during shipping and storage.

From 10% to 90% of the concentrate is organic diluent. From 0.5% to 90% of concentrate is the mixture of alkyl aryl sulfonates of alkaline earth metals of the present invention. The remainder of the concentrate consists of other additives.

Suitable organic diluents which can be used include for example, solvent refined 100N, i.e., Cit-Con 100N, and hydrotreated 100N, i.e., RLOP 100N, and the like. The organic diluent preferably has a viscosity of from about 1 to about 20 cSt at 100° C.

EXAMPLES OF ADDITIVE PACKAGES

Below are representative examples of additive packages that can be used in a variety of applications. These representative examples employ the LOB alkyl aryl sulfonates of the present invention. The following percentages are based on the amount of active component, with neither process oil nor diluent oil. These examples are provided to illustrate the present invention, but they are not intended to limit it.

Below are representative examples of additive packages that can be used in a variety of applications. These representative examples employ the LOB alkyl aryl sulfonates of the present invention. The following weight percents are based on the amount of active component, with neither process oil nor diluent oil. These examples are provided to illustrate the present invention, but they are not intended to limit it.

I. MARINE DIESEL ENGINE OILS

| | | |
|---|---|---|
| 1) | LOB alkyl aryl sulfonate | 65% |
| | Primary alkyl Zn-DTP | 5% |
| | Oil of lubricating viscosity | 30% |
| 2) | LOB alkyl aryl sulfonate | 65% |
| | Alkenyl succinimide ashless dispersant | 5% |
| | Oil of lubricating viscosity | 30% |
| 3) | LOB alkyl aryl sulfonate | 60% |
| | Primary alkyl Zn-DTP | 5% |
| | Alkenyl succinimide ashless dispersant | 5% |
| | Oil of lubricating viscosity | 30% |
| 4) | LOB alkyl aryl sulfonate | 65% |
| | Phenol type oxidation inhibitor | 10% |
| | Oil of lubricating viscosity | 25% |
| 5) | LOB alkyl aryl sulfonate | 55% |
| | Alkylated diphenylamine-type oxidation inhibitor | 15% |
| | Oil of lubricating viscosity | 30% |
| 6) | LOB alkyl aryl sulfonate | 65% |
| | Phenol-type oxidation inhibitor | 5% |
| | Alkylated diphenylamine-type oxidation inhibitor | 5% |
| | Oil of lubricating viscosity | 25% |
| 7) | LOB alkyl aryl sulfonate | 60% |
| | Primary alkyl Zn-DTP | 5% |
| | Phenol-type oxidation inhibitor | 5% |
| | Oil of lubricating viscosity | 30% |
| 8) | LOB alkyl aryl sulfonate | 60% |
| | Alkenyl succinimide ashless dispersant | 5% |
| | Alkylated diphenylamine-type oxidation inhibitor | 10% |
| | Oil of lubricating viscosity | 25% |

-continued

| | | |
|---|---|---|
| 9) | LOB alkyl aryl sulfonate | 55% |
| | Other additives | 25% |
| | Primary alkyl Zn-DTP | |
| | Alkenyl succinic ester ashless dispersant | |
| | Phenol-type oxidation inhibitor | |
| | Alkylated diphenylamine-type oxidation inhibitor | |
| | Oil of lubricating viscosity | 30% |
| II. | MOTOR CAR ENGINE OILS | |
| 1) | LOB alkyl aryl sulfonate | 25% |
| | Alkenyl succinimide ashless dispersant | 35% |
| | Primary alkyl Zn-DTP | 10% |
| | Oil of lubricating viscosity | 30% |
| 2) | LOB alkyl aryl sulfonate | 20% |
| | Alkenyl succinimide ashless dispersant | 40% |
| | Secondary alkyl Zn-DTP | 5% |
| | Dithiocarbamate type oxidation inhibitor | 5% |
| | Oil of lubricating viscosity | 30% |
| 3) | LOB alkyl aryl sulfonate | 20% |
| | Alkenyl succinimide ashless dispersant | 35% |
| | Secondary alkyl Zn-DTP | 5% |
| | Phenol type oxidation inhibitor | 5% |
| | Oil of lubricating viscosity | 35% |
| 4) | LOB alkyl aryl sulfonate | 20% |
| | Alkenyl succinimide ashless dispersant | 30% |
| | Secondary alkyl Zn-DTP | 5% |
| | Dithiocarbamate type anti-wear agent | 5% |
| | Oil of lubricating viscosity | 40% |
| 5) | LOB alkyl aryl sulfonate | 20% |
| | Succinimide ashless dispersant | 30% |
| | Secondary alkyl Zn-DTP | 5% |
| | Molybdenum-containing anti-wear agent | 5% |
| | Oil of lubricating viscosity | 40% |
| 6) | LOB alkyl aryl sulfonate | 20% |
| | Alkenyl succinimide ashless dispersant | 30% |
| | Other additives | 10% |
| | Primary alkyl Zn-DTP | |
| | Secondary alkyl Zn-DTP | |
| | Alkylated diphenylamine-type oxidation inhibitor | |
| | Dithiocarbamate type anti-wear agent | |
| | Oil of lubricating viscosity | 40% |
| 7) | LOB alkyl aryl sulfonate | 60% |
| | Other additives | 10% |
| | Phenol type oxidation inhibitor | |
| | Alkylated diphenylamine-type | |
| | Oxidation inhibitor | |
| | Dithiocarbamate type anti-wear agent | |
| | Demulsifier | |
| | Boron-containing friction modifier | |
| | Oil of lubricating viscosity | 30% |
| III. | HYDRAULIC OILS | |
| 1) | LOB alkyl aryl sulfonate | 20% |
| | Primary alkyl Zn-DTP | 50% |
| | Other additives | 25% |
| | Phenol type oxidation inhibitor | |
| | Phosphorous-containing extreme pressure agent | |
| | Triazol type corrosion inhibitor | |
| | Demulsifier | |
| | Nonionic anti-rust agent | |
| | Oil of lubricating viscosity | 5% |
| 2) | LOB alkyl aryl sulfonate | 10% |
| | Primary alkyl Zn-DTP | 40% |
| | Other additives | 47% |
| | Phenol type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 3% |
| 3) | LOB alkyl aryl sulfonate | 10% |
| | Phosphorous-containing extreme pressure agent | 40% |
| | Phenol type oxidation inhibitor | 15% |
| | Other additives | 25% |

-continued

| | | |
|---|---|---|
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 10% |
| 4) | LOB alkyl aryl sulfonate | 20% |
| | Phosphorous-containing extreme pressure agent | 30% |
| | Other additives | 45% |
| | Diphenylamine type oxidation inhibitor | |
| | Sulfur-containing extreme pressure agent | |
| | Triazol type corrosion inhibitor | |
| | Demulsifier | |
| | Nonionic anti-rust agent | |
| | Oil of lubricating viscosity | 5% |
| IV. | TRANSMISSION HYDRAULIC FLUIDS | |
| 1) | LOB alkyl aryl sulfonate | 35% |
| | Primary alkyl Zn-DTP | 20% |
| | Polyol type friction modifier | 20% |
| | Sulfur-containing extreme pressure agent | 5% |
| | Oil of lubricating viscosity | 20% |
| 2) | LOB alkyl aryl sulfonate | 40% |
| | Primary alkyl Zn-DTP | 15% |
| | Amide type friction modifier | 15% |
| | Sulfur-containing extreme pressure agent | 5% |
| | Oil of lubricating viscosity | 25% |
| 3) | LOB alkyl aryl sulfonate | 30% |
| | Primary alkyl Zn-DTP | 20% |
| | Other additives | 30% |
| | Alkenyl succinimide ashless dispersant | |
| | Amide type friction modifier | |
| | Ester type friction modifier | |
| | Phosphorous, Sulfur-containing extreme pressure agent | |
| | Oil of lubricating viscosity | 20% |
| 4) | LOB alkyl aryl sulfonate | 35% |
| | Primary alkyl Zn-DTP | 15% |
| | Other additives | 25% |
| | Polyol type friction modifier | |
| | Amide type friction modifier | |
| | Phosphorous, Sulfur-containing extreme pressure agent | |
| | Oil of lubricating viscosity | 25% |

EXAMPLES

The invention will be further illustrated by following examples, which set forth particularly advantageous method embodiments. While the Examples are provided to illustrate the present invention, they are not intended to limit it.

TESTS USED IN EXAMPLES

Viscosity at 100° C. (cSt)

The viscosity is measured at the temperature of 100° C. after dilution of the product sample to be measured in 100 N oil until a solution is obtained having a total calcium content of 2.35% by weight. Viscosity is measured following method ASTM D 445.

Skin Formation

This test is conducted at room temperature in an open jar of 200 ml where 30 grams of material to be tested is introduced.

If a skin formation appears only at least three days, the material is considered to be "good" not sensitive to water.

If a skin formation appears after 10 hours or one day, the material is considered to be "poor" that means too sensitive to water.

THE SULFONIC ACIDS USED

In the following examples, two sulfonic acids were used.

Sulfonic Acid I was formed from linear mono alkylates wherein the alkyl groups of those alkylates contain from 20 to 24 carbon atoms. The molecular weight of the alkylate is 410 it being 90 per cent monoalkylate and about 10% dialkylate (two olefins per benzene).

Sulfonic Acid II was formed from a mixture of alkylates consisting of 85% of the alkylate used in Sulfonic Acid I and 15% from BAB bottoms (branched alkylbenzene bottoms with MW 330). This is a bottoms product from the manufacture of propylene tetramer. Therefore the average MW of the mixed alkylate (Al584) sulfonated to AS584 is about 390–400.

The sulfonation reaction for both sulfonic acids was effected using sulfur trioxide $SO_3$, produced by the passage of a mixture of oxygen and sulfur dioxide $SO_2$ through a catalytic furnace containing vanadium oxide $V_2O_5$.

THE PHENATES USED

Phenate I is a carbonated sulfurized calcium phenate with 250 TBN. The alkylphenol it is made from is propylene tetramer on phenol.

Phenate II is a noncarbonated sulfurized phenate made from the same alkylphenol as described above. This phenate has a TBN of 114.

COMPARATIVE EXAMPLE A

A commercial LOB sulfonate having a BN of 17 was prepared by the traditional route of treating Sulfonic Acid II at 185° C. with formic acid, acetic acid, 2-ethylhexyl alcohol, water, calcium chloride, lime, and lube oil. Water was then distilled from the product. The resulting LOB sulfonate had a viscosity of 40 cSt at 100° C. There was a light skin in air.

COMPARATIVE EXAMPLE B

A LOB sulfonate having a BN of 15 was prepared by the procedures and the sulfonic acid shown in Comparative Example A, except that no calcium chloride was used. The resulting LOB sulfonate had a viscosity of 521 cSt at 100° C. This Comparative Example shows that the conventional process would not produce the desired viscosity without using chloride to control viscosity.

EXAMPLE 1

In this example, 31.4 grams of 100N oil were mixed with 17.1 grams of Phenate I. This mixture was heated to 120° C. To the mixture was added 50 grams of Sulfonic Acid I over a period of 10 minutes while mixing. After a further reaction period of 15 minutes, the product had a TBN of 22.5 and a viscosity of 64 cSt at 100° C. with a light skin in air.

EXAMPLE 2

In this example, 1.5 grams of lime were added to 29.7 grams of 100N oil and heated to 120° C. To this mixture was added 20.7 grams of Sulfonic Acid II. The lime was 10% in excess of the amount required to neutralize this acid. After mixing for 10 minutes, 17.1 grams of Phenate I were added to the mixture. Then another 31.0 grams of Sulfonic Acid II were added with mixing over a period of ten minutes, After another 15 minutes, the product was analyzed. The TBN was 19.4 and the viscosity 38 cSt with a light skin in air. In this example approximately 40 per cent of the sulfonic acid was neutralized with lime, the remaining 60 per cent being neutralized by the phenate.

EXAMPLE 3

In this example, 50 grams of Sulfonic Acid I was used in 39.4 grams 100N oil, 3.4 grams of lime, and 7.2 grams Phenate I, resulting in an estimated 19 TBN product, having a viscosity of 107 cSt at 100° C. with a light skin in air. The lime was used to neutralize 100% of the acid.

EXAMPLE 4

In this example, 5 grams Phenate I was blended into the product of Example 3, resulting in an estimated 29 TBN product, having a viscosity of 74 cSt at 100° C.

EXAMPLE 5

In this example, 50.8 grams of Sulfonic Acid II was used in 35 grams 100N oil, 3.5 grams of lime, and 10 grams Phenate II, resulting in an estimated 13 TBN product, having a viscosity of 63 cSt at 100° C. with a light skin in air. The lime was used to neutralize 100% of the acid.

EXAMPLE 6

In this example, 51.7 grams of Sulfonic Acid II was used in 37.6 grams 100N oil, 3.5 grams of lime, and 7.2 grams Phenate I, resulting in an estimated 17 TBN product, having a Viscosity of 67 cSt at 100° C. The lime was used to neutralize 100% of the acid.

While the present invention has been described with reference to specific embodiments, this application is intended to cover those various changes and substitutions that may be made by those skilled in the art without departing from the spirit and scope of the appended claims.

What is claimed is:

1. A process for producing a low viscosity, neutral alkyl aryl sulfonate detergent having a Base Number of up to 30 comprising a process selected from the group consisting of:

(a) the process comprising neutralization of sulfonic acid with a high TBN metal salt of an alkyl hydroxyl aromatic;

(b) the process comprising partial neutralization of sulfonic acid with lime, followed by continued neutralization of the sulfonic acid with a high TBN metal salt of an alkyl hydroxyl aromatic; and (c) the process comprising neutralization of sulfonic acid with lime, followed by treatment of the neutralized sulfonic acid with a high TBN metal salt of an alkyl hydroxyl aromatic;

wherein the neutralized product has a Base Number of up to 30.

2. A process according to claim 1 wherein part of the sulfonic acid is neutralized with lime prior to the neutralization of the sulfonic acid with the high TBN metal salt of an alkyl hydroxyl aromatic.

3. A process according to claim 1 wherein said neutralization is carried out in the absence of chloride.

4. A process according to claim 3 wherein said neutralization is carried out in the absence of additional carboxylic acid.

5. A process according to claim 1 wherein said high TBN metal salt of an alkyl hydroxyl aromatic is a sulfurized carbonated alkaline earth alkylphenate and said low overbased alkyl aryl sulfonate is an alkyl phenyl sulfonate.

6. A process according to claim 5 wherein said alkaline earth metal is calcium.

7. A process according to claim 4 wherein the alkyl group of said calcium alkylphenate has from 10 to 40 carbon atoms.

8. A neutral alkyl phenyl sulfonate detergent having a Base Number of up to 30 produced by the process according to claim 3.

9. A lubricating oil formulation comprising:

(a) a major amount of a base oil of lubricating viscosity;

(b) from 0.5 to 40% of a neutral alkyl phenyl sulfonate detergent according to claim 8;

(c) from 0 to 20% of at least one ashless dispersant;

(d) from 0 to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

10. A concentrate comprising about from 10 weight % to 90 weight % of a compatible organic liquid diluent and about from 0.5 weight % to 90 weight % of a neutral alkyl phenyl sulfonate according to claim 8.

11. A method of producing a lubricating oil composition comprising blending the following components together:

(a) a major amount of a base oil of lubricating viscosity;

(b) from 0.5 to 40% of a low overbased alkyl phenyl sulfonate according to claim 8;

(c) from 0 to 20% of at least one ashless dispersant;

(d) from 0 to 5% of at least one zinc dithiophosphate;

(e) from 0 to 10% of at least one oxidation inhibitor;

(f) from 0 to 1% of at least one foam inhibitor; and (g) from 0 to 20% of at least one viscosity index improver.

12. A lubricating oil composition produced by the method according to claim 11.

* * * * *